US011745920B2

(12) United States Patent
Tani

(10) Patent No.: US 11,745,920 B2
(45) Date of Patent: Sep. 5, 2023

(54) APPLICATION CONTAINER WITH WEAKENED PORTION

(71) Applicant: TOKIWA CORPORATION, Nakatsugawa (JP)

(72) Inventor: Yoshikazu Tani, Kawaguchi (JP)

( * ) Notice: Subject to any disclaimer, the term of this patent is extended or adjusted under 35 U.S.C. 154(b) by 7 days.

(21) Appl. No.: 17/407,185

(22) Filed: Aug. 20, 2021

(65) Prior Publication Data

US 2022/0055803 A1 Feb. 24, 2022

(30) Foreign Application Priority Data

Aug. 24, 2020 (JP) ..... 2020-140998

(51) Int. Cl.

| | |
|---|---|
| ***B65D 41/34*** | (2006.01) |
| ***A45D 40/26*** | (2006.01) |
| ***B65D 51/24*** | (2006.01) |
| *A45D 40/00* | (2006.01) |

(52) U.S. Cl.

CPC ..... *B65D 41/34* (2013.01); *A45D 40/26* (2013.01); *B65D 51/245* (2013.01); *A45D 2040/0006* (2013.01)

(58) Field of Classification Search

CPC ..... B65D 41/34; B65D 51/245; A45D 40/26; A45D 2040/0006

USPC ..... 220/266; 215/47, 48

See application file for complete search history.

(56) References Cited

U.S. PATENT DOCUMENTS

| | | | | |
|---|---|---|---|---|
| 4,747,501 | A * | 5/1988 | Greaves | B65D 51/223 220/276 |
| 6,234,333 | B1 * | 5/2001 | Federighi | B65D 1/095 222/541.9 |
| 6,237,789 | B1 * | 5/2001 | Zhu | B65D 55/02 215/256 |
| 8,672,157 | B2 * | 3/2014 | Fontana | B29C 45/0081 215/325 |
| 8,833,576 | B2 * | 9/2014 | Fontana | B65D 1/0246 222/541.6 |
| 2003/0155356 | A1 * | 8/2003 | Fontana | B65D 47/36 220/276 |
| 2007/0007227 | A1 * | 1/2007 | Fontana | B65D 1/095 215/250 |
| 2020/0239198 | A1 * | 7/2020 | Finch | B65D 50/00 |

FOREIGN PATENT DOCUMENTS

| | | |
|---|---|---|
| JP | 2604462 | 5/2000 |

* cited by examiner

*Primary Examiner* — J. Gregory Pickett
*Assistant Examiner* — Niki M Eloshway
(74) *Attorney, Agent, or Firm* — SOEI PATENT & LAW FIRM

(57) ABSTRACT

An application container includes a main body that holds an application material, a cap, and a weakened portion that connects the cap to an outer peripheral surface of the main body. The main body has a tubular shape that extends in an axial direction and forms an opening to expose the application material. The cap overlaps the opening of the main body in the axial direction. The weakened portion is oriented substantially in a circumferential direction of the main body, at a position that is located away from the opening in the axial direction of the main body, and is configured to be split in response to an external force, so as to separate the cap from the main body.

4 Claims, 13 Drawing Sheets

APPLICATION CONTAINER WITH WEAKENED PORTION

CROSS-REFERENCE TO RELATED APPLICATIONS

This application claims the benefit of priority from Japanese Patent Application No. 2020-140998, filed Aug. 24, 2020, the entire contents of which are incorporated herein by reference.

BACKGROUND

Japanese Utility Model Registration No. 2604462 discloses a storage container having a tubular shape and storing a paste-like filling material. The storage container includes an upper main wall portion having a tubular shape, and a lower main wall portion having a tubular shape and facing a partition wall portion of the upper main wall portion. The inside of the lower main wall portion is filled with the paste-like filling material facing the partition wall portion. The paste-like filling material is exposed in an end portion on a partition wall portion side of the lower main wall portion.

The shape of the exposed paste-like filling material is a spherical shape, and the partition wall portion has a spherical shape according to the shape of the paste-like filling material. A thick portion and a thin portion extending from the thick portion along a circumferential direction of the storage container are disposed between the upper main wall portion and the lower main wall portion. An arrow is displayed on an opposite side of an outer peripheral surface of the upper main wall portion from the thick portion. When the arrow portion of the upper main wall portion is pressed, the thin portion is broken, and the paste-like filling material is exposed.

Before breakage, a larger diameter portion is formed on an opposite side of the upper main wall portion from the lower main wall portion, and the inner diameter of the larger diameter portion is substantially the same as the outer diameter of the lower main wall portion. Therefore, after the upper main wall portion is broken from the lower main wall portion, the larger diameter portion of the upper main wall portion can be fitted to the lower main wall portion. When the larger diameter portion of the upper main wall portion is fitted to the lower main wall portion from which the paste-like filling material is exposed, the upper main wall portion can be used as a lid member.

In the above-described storage container, the thin portion to be broken is provided between the upper main wall portion and the lower main wall portion, and the paste-like filling material protrudes in a spherical shape from the lower main wall portion to the upper main wall portion. In addition, a broken portion of the thin portion serves as an opening from which the paste-like filling material is exposed. Therefore, since the thin portion to be broken is located on a radial outer side of the paste-like filling material, when the thin portion is broken, a cut end of the thin portion or an inner wall of the upper main wall portion may come into contact with the paste-like filling material.

As described above, since a part of the storage container may come into contact with an application material such as a paste-like filling material when cutting is performed at the thin portion, there is a likelihood that the application material is damaged during cutting. In addition, the surface of an edge of the opening which is a cut portion of the thin portion and from which the application material is exposed may be roughened by cutting. Accordingly, when the application material is applied to an application target portion such as the skin of a person, the portion roughened by cutting comes into contact with the application target portion.

SUMMARY

Example application containers described herein prevent an application material from being damaged when cutting is performed, and improve ease of use.

According to an aspect of the present disclosure, there is provided an application container including a main body to hold an application material, in which the main body has a tubular shape extending in an axial direction and forming an opening to expose the application material, a cap that overlaps the opening of the main body in the axial direction, and a weakened portion (or cutting portion) that connects the cap to an outer peripheral surface of the main body. The weakened portion extends substantially in a circumferential direction (e.g., a rotation direction) of the main body, at a position located away from the opening in the axial direction of the main body, and the weakened portion is configured to be split in response to an external force, so as to separate the cap from the main body.

The application container includes the main body having a tubular shape and holding the application material, and the cap having a tubular shape. The main body includes the opening that exposes the application material. The cap overlaps the opening in the axial direction of the main body. The weakened portion (or cutting portion) that connects the main body to the cap is provided between the main body and the cap, and when cutting is performed at the weakened portion (or cutting portion), the cap is separable from the main body. The weakened portion (or cutting portion) is provided at the position located away from (e.g., separated or offset from) the opening in the axial direction of the main body, with the application material being exposed from the opening, and connects the outer peripheral surface of the main body and the cap to each other at the position that is located away from the opening. Accordingly, since the weakened portion (or cutting portion) is provided at the position located away from the opening in the axial direction, the cap or the like can be prevented from coming into contact with the application material when cutting is performed at the cutting portion. Namely, since cutting is performed at the position located away (or offset) from the opening, the cap or the like can be prevented from coming into contact with the application material when cutting is performed. Therefore, the application material can be protected by preventing the application material from being damaged when cutting is performed. In addition, even when a place where cutting is performed is rough, since the cutting portion is provided at the position that is offset from the opening in the axial direction, a rough portion or surface can be prevented from coming into contact with a target portion (e.g., a target surface) when the application material is abutted against and applied to the target portion. Therefore, the rough portion can be prevented from coming into contact with the target portion, to improve the ease of use of the application material.

The cap may include a tubular portion that overlaps the opening of the main body in the axial direction, and a wing portion protruding from the tubular portion in a direction intersecting an axial direction of the tubular portion. In this case, when the cap is rotated by hand with respect to the main body, the wing portion protruding from the tubular portion can be caught by the hand, to more easily rotate the cap (e.g., so that a rotation can be performed with a relatively weak force).

The wing portion may include an information display portion displaying information regarding the application material. In this case, the wing portion protruding from the tubular portion of the cap can be more effectively used as the information display portion that displays the information. Namely, since the wing portion protrudes in a wing shape from the tubular portion, an outer surface of the wing portion can be effectively used as the information display portion.

When the cap is rotated with respect to the main body, the cap may be separable from the main body along the weakened portion (or cutting portion). The weakened portion (or cutting portion) may include a plurality of connection portions that are arranged in the circumferential direction (e.g., rotation direction), and that connect the cap and the main body to each other, and a plurality of gaps arranged in the circumferential direction (e.g., rotation direction) between adjacent pairs of the connection portions. In this case, since the plurality of connection portions are intermittently provided in the weakened portion (or cutting portion) along the circumferential direction (e.g., rotation direction), the cap can be more easily cut (e.g., separated) from the main body in response to a rotation of the cap relative to the main body.

The outer peripheral surface of the main body may include a recess that extends in the circumferential direction (e.g., rotation direction), and a step portion located adjacent the recess, that has a greater diameter than the recess. The recess may be offset from the opening in the axial direction and located between the opening and the step portion. The weakened portion (or cutting portion) may be formed in the recess. In this case, since the weakened portion (or cutting portion) is formed in the recess, even when the weakened portion (or cutting portion) forms a rough portion or surface after cutting, such a rough portion or surface can be prevented from protruding from the outer peripheral surface of the main body. Namely, even when a rough portion or surface results from the cutting, the rough portion is located in the recess, so that the rough portion is less likely to protrude relative to the outer peripheral surface of the main body. Consequently, a likelihood that the rough portion resulting from the cutting operation, comes into contact with the target portion can be further reduced, thereby improving the ease of use of the application material.

According to some examples described herein, it is possible to prevent the application material from being damaged when cutting is performed, and to improve the ease of use.

DETAILED DESCRIPTION

In the following description, with reference to the drawings, the same reference numbers are assigned to the same components or to similar components having the same function, and overlapping description is omitted.

Figure 1:
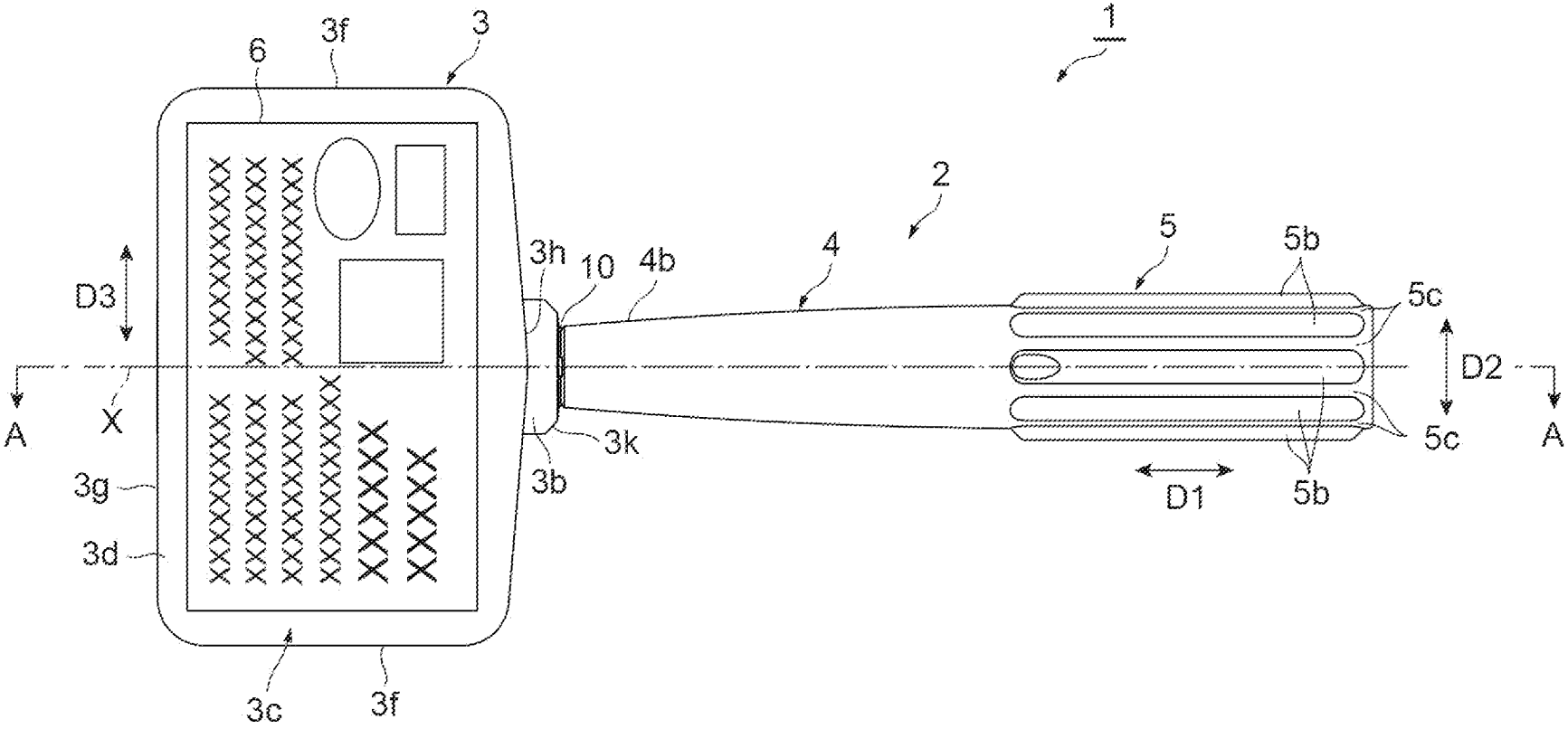
FIG. 1 is a top view illustrating an example application container.
Figure 2:
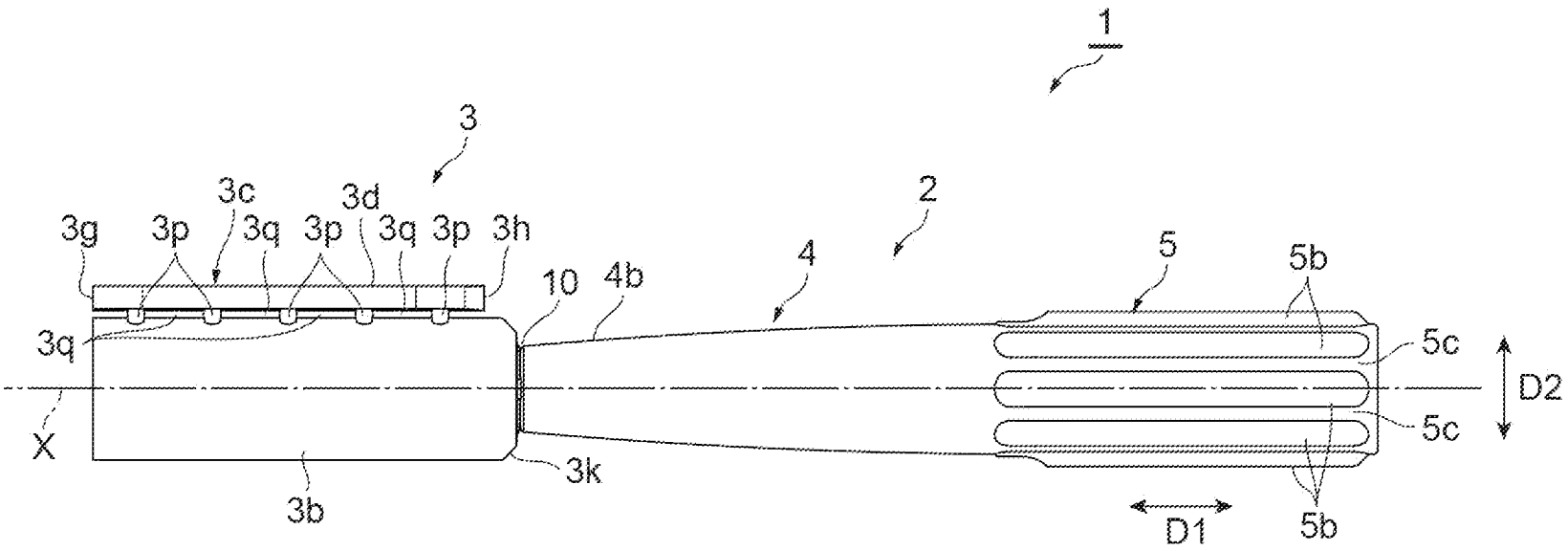
FIG. 2 is a side view of the application container illustrated in FIG. 1.
Figure 3:
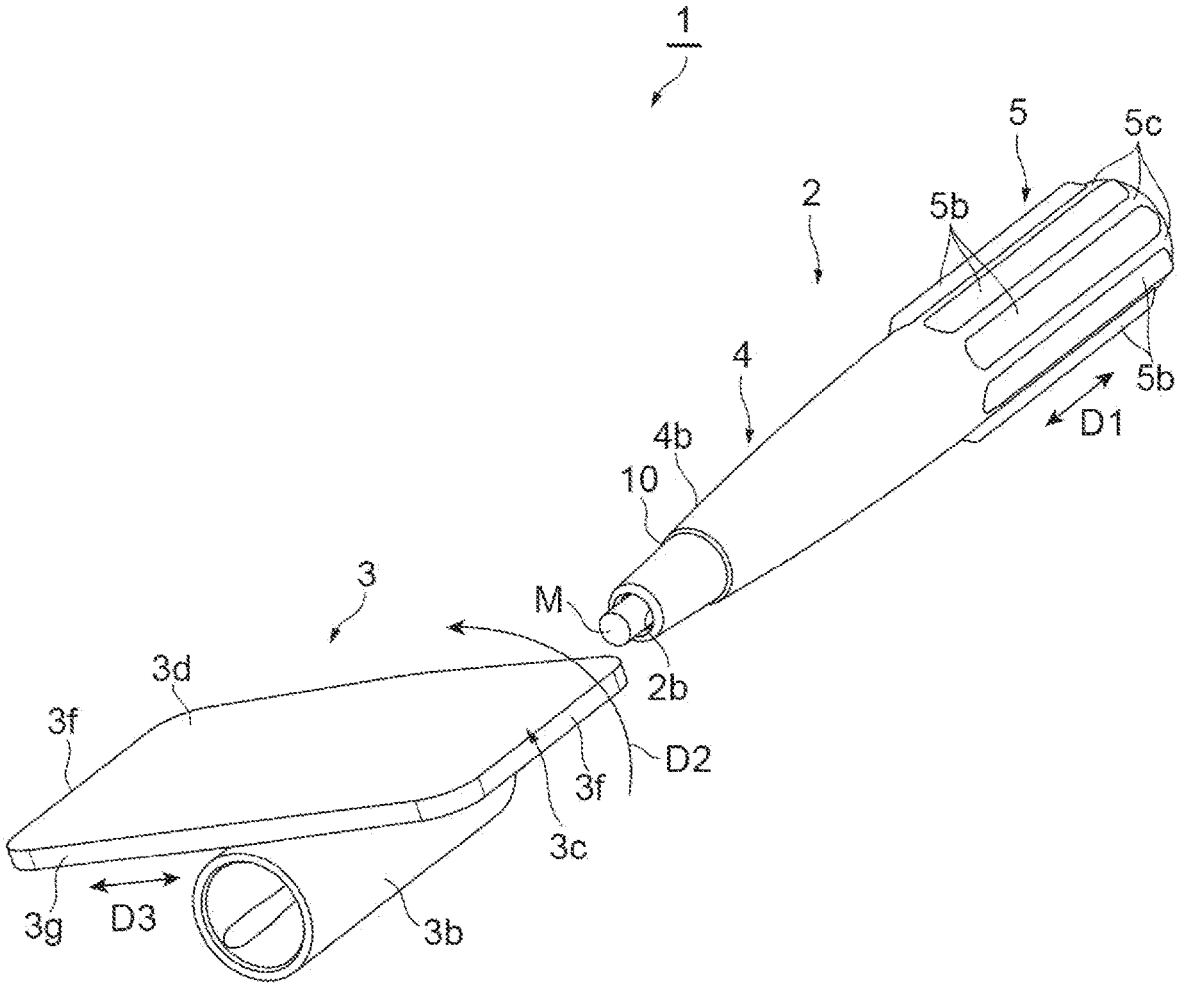
FIG. 3 is a perspective exploded view of the application container illustrated in FIG. 1.

With reference to FIGS. 1 to 3, an application container 1 includes a main body 2 having a stick shape extending along an axial direction D1, and a cap 3 that is to be cut or separated from the main body 2 via a weakened portion (or cutting portion) 10. In the present disclosure, an "axis" of the application container refers to a central axis of the application container, and the "axial direction" is a direction in which the axis of the application container extends. The "axial direction" coincides with, for example, a longitudinal direction of the application container 1.

The application container 1 is, for example, a cosmetic container that holds a cosmetic M which is an application material. In the present disclosure, the "application material" refers to a material that is to be applied to a portion (or surface) to be coated which is an application target or "target portion". The "application material" may be, for example, cosmetics or cosmetic application tools such as puffs, sponges, tips, impregnated bodies or brushes, or drawing materials such as pencils or stationery. The "target portion" refers to a target (e.g., a surface) that is to be coated with or that is to receive the application material. Examples of the "target portion" include the skin of a user of the application container 1, or paper, for example.

As one example, the application container 1 is a small-quantity cosmetic container, that may be used as a tester or a free sample. In this case, the application container 1 has a configuration simpler than that of other dispensing containers or the like that dispense a cosmetic. In some examples, the cutting portion (or weakened portion) 10 is broken (e.g., split) to separate the cap 3 from the main body 2 by applying an external force, such as by rotating the cap 3 with respect to the main body 2 in a rotation direction (or circumferential direction) D2.

The main body 2 includes an opening 2*b* from which the cosmetic M is exposed. When the cap 3 is separated from the main body 2, the cosmetic M held by the main body 2 is exposed together with the opening 2*b*, and the application container 1 is used. The rotation direction D2 refers to a direction in which the cap 3 rotates around an axis X of the application container 1.

The cosmetic M is, as one example, a stick-shaped cosmetic. The cosmetic M is, for example, an eyebrow cosmetic, and the application container 1 is an eyebrow cosmetic holding container. In other examples, the cosmetic M may be an eyeliner, a concealer, a lip liner, or the like, other than an eyebrow cosmetic, and is not particularly limited.

The main body 2 has a stick shape extending in the axial direction D1. The main body 2 includes, for example, a tubular tip portion 4 including an outer peripheral surface 4*b* that gradually increases in diameter rearwardly from the cutting portion 10, and a grip portion 5 extending in the axial direction D1 at a rear end portion located opposite the tubular tip portion 4 relative to the cutting portion 10. The grip portion 5 includes a plurality of projections 5*b*, which are arranged along the rotation direction D2, to more easily grip the grip portion 5, for example, with fingers. Each of the plurality of projections 5*b* has an elliptical shape extending along the axial direction D1.

Figure 4:
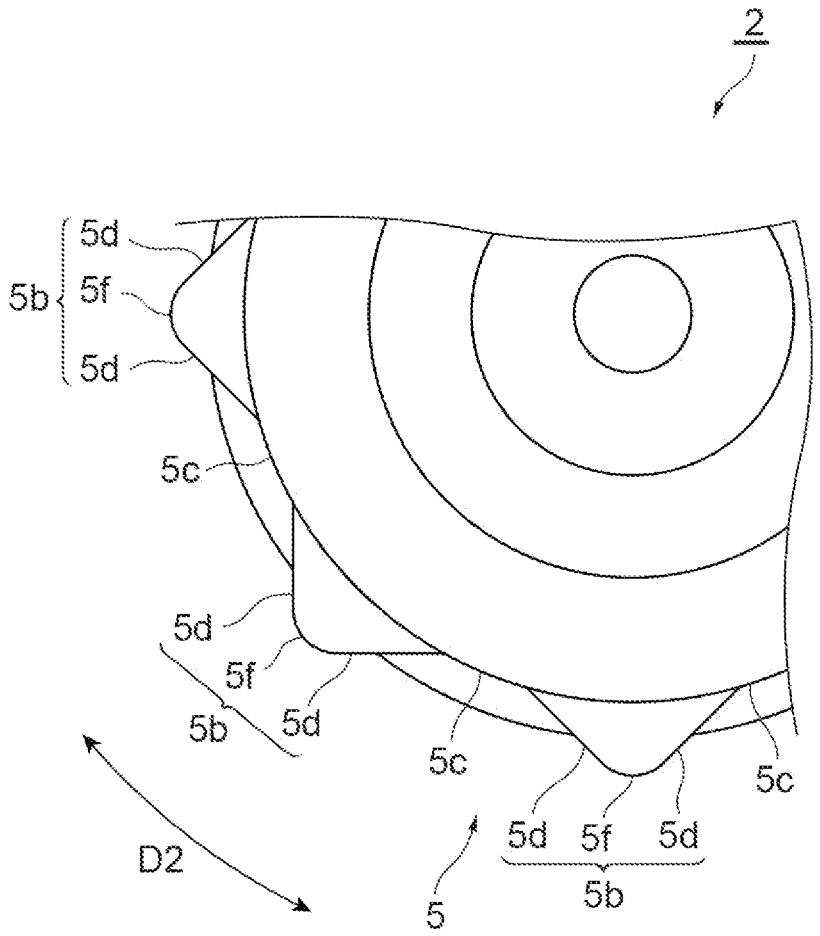
FIG. 4 is an enlarged partial view of an outer surface of a main body portion of the application container illustrated in FIG. 1.

FIG. 4 is a rear view of the grip portion 5 as viewed from an end of the main body 2 opposite the opening 2*b*. As illustrated in FIG. 4, each of the projections 5*b* of the grip portion 5 has a mountain shape including a rounded tip. For example, the projection 5*b* includes a pair of inclined surfaces 5*d* that extend obliquely from an outer surface 5*c* of the grip portion 5 and are arranged along the rotation direction D2, and a curved portion 5*f* protruding outward in a radial direction of the grip portion 5 between the pair of inclined surfaces 5*d*. In some examples, the grip portion 5 includes eight projections 5*b*, and the eight projections 5*b* are arranged at equal intervals along the rotation direction D2. The shape of the projection of the grip portion 5 is not limited to the shape of the illustrated projection 5*b*.

As illustrated in FIGS. 1 to 3, the cap 3 includes a tubular portion 3*b* covering the opening 2*b* of the main body 2 and the cosmetic M, and a wing portion 3*c* protruding from the tubular portion 3*b* in a lateral direction D3 intersecting the axial direction D1. Namely, the tubular portion 3*b* overlaps the opening 2*b* of the main body 2 in the axial direction, as well as the cosmetic M that is exposed at the opening 2*b*. The tubular portion 3*b* includes an inclined surface 3*k* at an end portion adjacent the cutting portion 10. The inclined surface 3*k* is inclined in a direction so that the diameter of the tubular portion 3*b* is reduced toward the cutting portion 10. The wing portion 3*c* extends, for example, in the lateral direction D3 to widen from the tubular portion 3*b*. Namely, the wing portion 3*c* extends from the tubular portion 3*b* to both sides of the tubular portion 3*b* along the lateral direction D3. The wing portion 3*c* has a plate shape including a main surface 3*d* extending in both the axial direction D1 and the lateral direction D3.

The main surface 3*d* includes an information display portion 6 as will be described further below. The information display portion 6 is a portion on which application material information may be displayed. The "application material information" refers to information regarding the application material, and may include, for example, at least one of information regarding production of the application material (as one example, the place of production), container information, type, name, brand, and regulation.

The main surface 3*d* has, for example, a substantially flat shape. The main surface 3*d* has a rounded rectangular shape as one example. For example, the main surface 3*d* includes a pair of short sides 3*f* extending in the axial direction D1, a long side 3*g* extending in the lateral direction D3 between first ends of the pair of short sides 3*f*, and a mountain portion 3*h* protruding toward the center in the lateral direction D3 between second ends of the pair of short sides 3*f*. The wing portion 3*c* is fixed to the tubular portion 3*b* such that the mountain portion 3*h* is located adjacent the cutting portion 10 and the long side 3*g* is located adjacent an end of the cap opposite the cutting portion 10.

The cap 3 includes a fixing portion 3*p* that fixes the wing portion 3*c* to the tubular portion 3*b*, and for example, a plurality of the fixing portions 3*p* are arranged along the axial direction D1. A gap 3*q* is formed between adjacent ones of the fixing portions 3*p* in the axial direction D1, such that a plurality of the gaps 3*q* are arranged along the axial direction D1.

In some examples, the length of the fixing portion 3*p* in the axial direction D1 is shorter than the length of the gap 3*q* in the axial direction D1. The fixing portion 3*p* has, for example, a pointed shape, so as to reduce thick portions of the wing portion 3*c*. Accordingly, the occurrence of sink marks resulting from the molding of the cap 3 can be suppressed.

Figure 5:
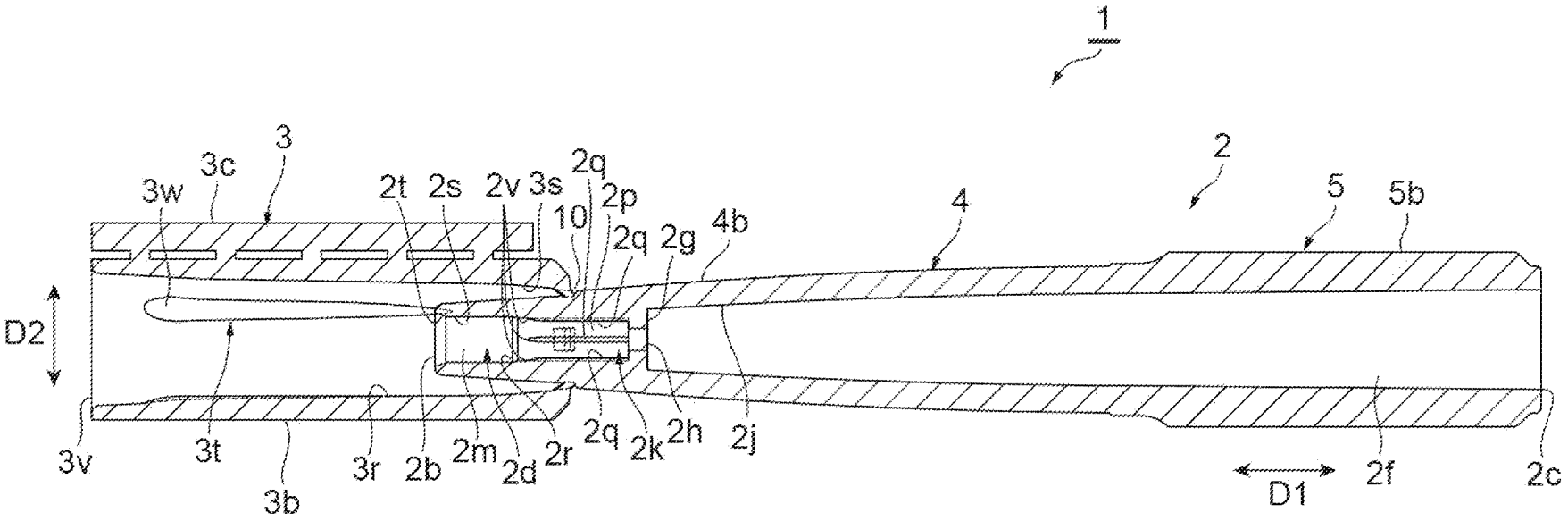
FIG. 5 is a cross-sectional view of the application container illustrated in FIG. 1, taken along line A-A.

As illustrated in FIG. 5, in some examples, the application container 1 is integrally molded. In this case, the application container 1 can be easily produced by disposing respective molds on a first side and a second side in the axial direction D1, and performing injection molding with a pair of the molds arranged along the axial direction D1. As one example, the material of the application container 1 may be polypropylene (PP). The material of the application container 1 is not limited to PP, and may include other resin materials.

The main body 2 has, for example, a tubular shape including the opening 2*b* at a first end in the axial direction D1 and an opening 2*c* at a second end opposite the first end, in the axial direction D1. The main body 2 has a first internal space 2*d* which extends from the opening 2*b* in the axial direction D1 and into which the cosmetic M is inserted, and a second internal space 2*f* extending from the opening 2*c* in the axial direction D1.

The main body 2 further includes a wall portion 2*g* that partitions the first internal space 2*d* from the second internal space 2*f*, and a through-hole 2*h* is for pied in the wall portion 2*g* to penetrate therethrough in the axial direction D1. The second internal space 2*f* is defined by an inner surface 2*j* that increases in diameter from the wall portion 2*g* in correspondence with the outer peripheral surface 4*b* of the tubular tip portion 4. Accordingly, the thickness of the tubular tip portion 4 in the main body 2 can be substantially constant, to suppress the occurrence of sink marks.

The first internal space 2*d* of the main body 2 includes a holding portion 2*k* that holds the cosmetic M, and an increased diameter portion 2*m* that has a diameter greater than a diameter of the holding portion 2*k*. The holding portion 2*k* includes an inner surface 2*p* to face an outer periphery of the cosmetic M, and a protrusion portion 2*q* protruding from the inner surface 2*p*. The holding portion 2*k* includes, for example, a plurality of the protrusion portions 2*q*. Each of the protrusion portions 2*q* extends along the axial direction D1. As one example, four protrusion portions 2*q* are arranged at equal intervals along the rotation direction (or circumferential direction) D2.

The protrusion portion 2*q* extending along the axial direction D1 includes a tapered portion 2*v* in an end portion in the axial direction D1, the tapered portion 2*v* being narrowed in width (dimension in the rotation direction D2) toward the opening 2*b*. The increased diameter portion 2*m* is located between the holding portion 2*k* and the opening 2*b*. As one example, the increased diameter portion 2*m* includes a first tapered surface 2*r* that has a diameter greater than a diameter of the holding portion 2*k*, an inner peripheral surface 2*s* extending from the first tapered surface 2*r* in the axial direction D1, and a second tapered surface 2*t* that increases in diameter from the inner peripheral surface 2*s* to the opening 2*b*.

Figure 6:
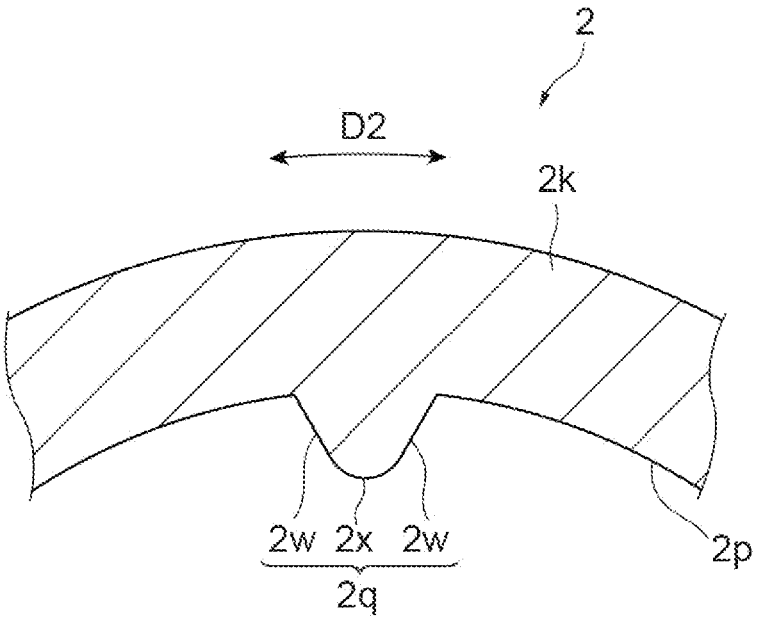
FIG. 6 is an enlarged partial cross-sectional view of an inner surface of the main body portion of the application container illustrated in FIG. 1.

FIG. 6 is a cross-sectional view of the holding portion 2*k* of the main body 2 taken along a plane that is orthogonal to the axial direction D1. As illustrated in FIGS. 5 and 6, the protrusion portion 2q has, for example, a V shape pointing radially inwardly from an inner surface of the main body 2 and including a rounded tip. Specifically, the protrusion portion 2q includes a pair of inclined surfaces 2w that extend obliquely from the inner surface 2p and are arranged along the rotation direction D2, and a curved surface 2x protruding radially inwardly between the pair of inclined surfaces 2w. The protrusion portion 2q corresponds to a portion penetrating into the cosmetic M. The protrusion portion 2q penetrates into an outer peripheral surface of the cosmetic M, so that the cosmetic M is held by the holding portion 2k. The shape of the protrusion portion is not limited to the shape of the protrusion portion 2q illustrated.

Before the cap 3 is cut from the main body 2 via the cutting portion (or weakened portion) 10, the cap 3 includes an inner surface 3r that gradually increases in diameter forwardly away from the cutting portion 10, and an opening 3v provided at a front end, opposite the cutting portion 10. Inside the cap 3, a recess 3s is defined by the inner surface 3r, the cutting portion 10, and the outer peripheral surface 4b of the tubular tip portion 4. The recess 3s is, for example, a circumferential recess extending in the rotation direction D2.

The width of the recess 3s in the radial direction is gradually narrowed from the opening 2b of the main body 2 toward the cutting portion 10. As described above, the cap 3 can be cut from the main body 2 through the cutting portion 10, and the orientation of the cap 3 in the axial direction D1 can be reversed so as to mount the cap 3 onto the main body 2 via the opening 3v.

When the cap 3 is mounted on the main body 2 in the reversed orientation, the opening 3v is positioned adjacent a base portion of the main body 2, namely, adjacent a portion of the outer peripheral surface 4b that is offset from the opening 2b in the axial direction D1. Additionally, a broken portion of the cutting portion 10 forms an opening opposite the opening 3v. A plug may be inserted into this opening. In this case, when the cosmetic M is made of a high volatile material, the volatilization of the cosmetic M can be suppressed.

Figure 7:
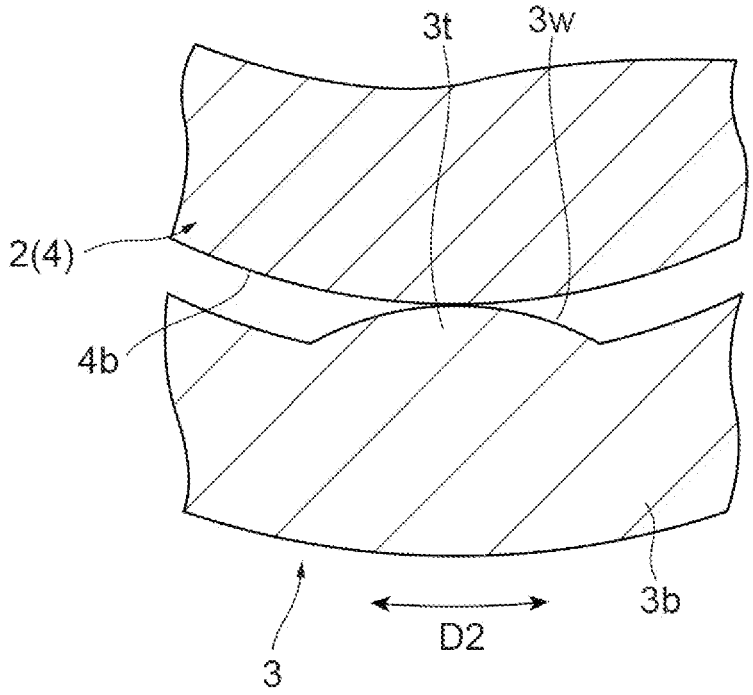
FIG. 7 is an enlarged partial cross-sectional view of a cap and a main body of the application container in FIG. 1.

The cap 3 includes, on the inner surface 3r, a protrusion portion 3t which abuts against the outer peripheral surface 4b of the main body 2. The protrusion portion 3t abuts against the outer peripheral surface 4b, so that the cap 3 is mounted on the main body 2. FIG. 7 is a cross-sectional view of the protrusion portion 3t of the cap 3 mounted on the main body 2, taken along a plane orthogonal to the axial direction D1. As illustrated in FIGS. 5 and 7, the protrusion portion 3t includes a curved surface 3w protruding radially inwardly from an inner surface of the cap 3. In a cross section taken along the plane orthogonal to the axial direction D1, for example, the curved surface 3w is curved convexly in an arc shape. The curved surface 3w of the protrusion portion 3t abuts against the outer peripheral surface 4b of the main body 2, so that the cap 3 is mounted on (e.g., contacts) the main body 2.

In some examples, the protrusion portion 3t has a linear shape extending longitudinally in the axial direction D1, and the width (length in the rotation direction D2) of the protrusion portion 3t is narrowed rearwardly away from the opening 3v. A first longitudinal end of the protrusion portion 3t in the axial direction D1 is located between an axial center of the cap 3 and the opening 3v in the axial direction D1, and for example, is rounded so as to extend convexly in the axial direction D1. A second longitudinal end of the protrusion portion 3t in the axial direction D1 is located between an axial center of the cap 3 and the cutting portion 10 in the axial direction D1. In a state before the cap 3 is cut from the main body 2 via the cutting portion 10, for example, the second longitudinal end of the protrusion portion 3t in the axial direction D1 points to the opening 2b of the main body 2.

Figure 8:
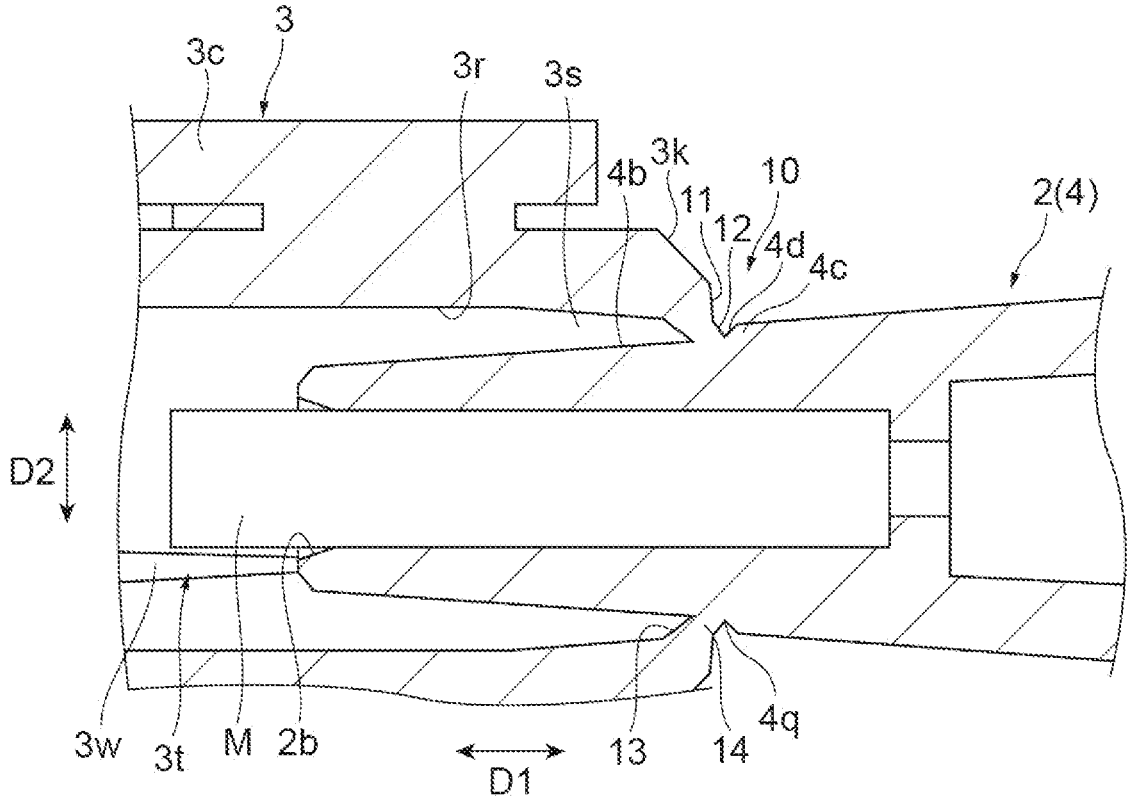
FIG. 8 is an enlarged cross-sectional view illustrating a cutting portion of the application container of FIG. 1.

FIG. 8 is an enlarged cross-sectional view illustrating part of the main body 2 and part of the cap 3 around the cutting portion 10. As illustrated in FIG. 8, the cutting portion 10 is provided at a position located away (or offset) from the opening 2b of the main body 2 in the axial direction D1. Namely, the cutting portion 10 is located between the grip portion 5 (toward the base portion of the main body 2) and the opening 2b located at a tip of the main body 2, and connects the outer peripheral surface 4b of the tubular tip portion 4 of the main body 2 to an end portion (adjacent the inclined surface 3k) of the cap 3 in the axial direction D1.

Figure 9:
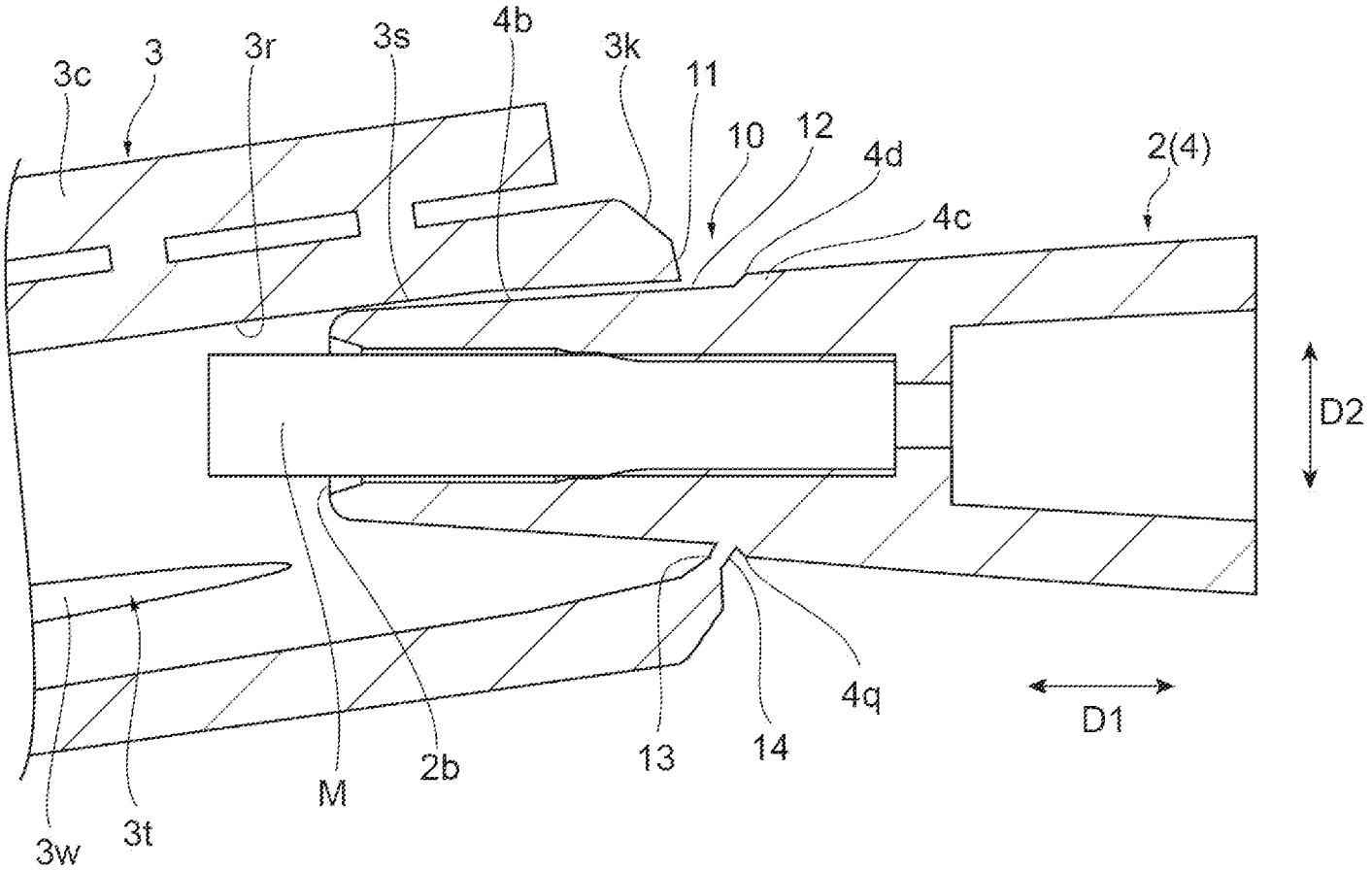
FIG. 9 is a cross-sectional view illustrating a state where cutting is performed at the cutting portion of FIG. 8.

FIG. 9 is a cross-sectional view illustrating a state where cutting is performed at the cutting portion (or weakened portion) 10. With reference to FIGS. 8 and 9, the cutting portion 10 is formed not at the opening 2b of the main body 2 but toward the base portion of the main body 2 away from the opening 2b. Since the cutting portion 10 is provided at the position located away (or offset) from the opening 2b, after the cap 3 is separated from the main body 2 along the cutting portion 10 to form a cut portion, the cut portion can be prevented from abutting against the target portion (e.g., target surface) when the cosmetic M is applied. In addition, since the cutting portion 10 is located away (or offset) from the cosmetic M exposed at the opening 2b, the cosmetic M can also be prevented from being damaged when the cap 3 is separated at the cutting portion 10. For example, when the cap 3 is separated from the main body 2, the inner surface 3r of the cap 3 contacts not the cosmetic M but rather the outer peripheral surface 4b of the tubular tip portion 4. Therefore, the cap 3 can be prevented from coming into contact with the cosmetic M so as to protect the cosmetic M from being damaged.

Figure 10:
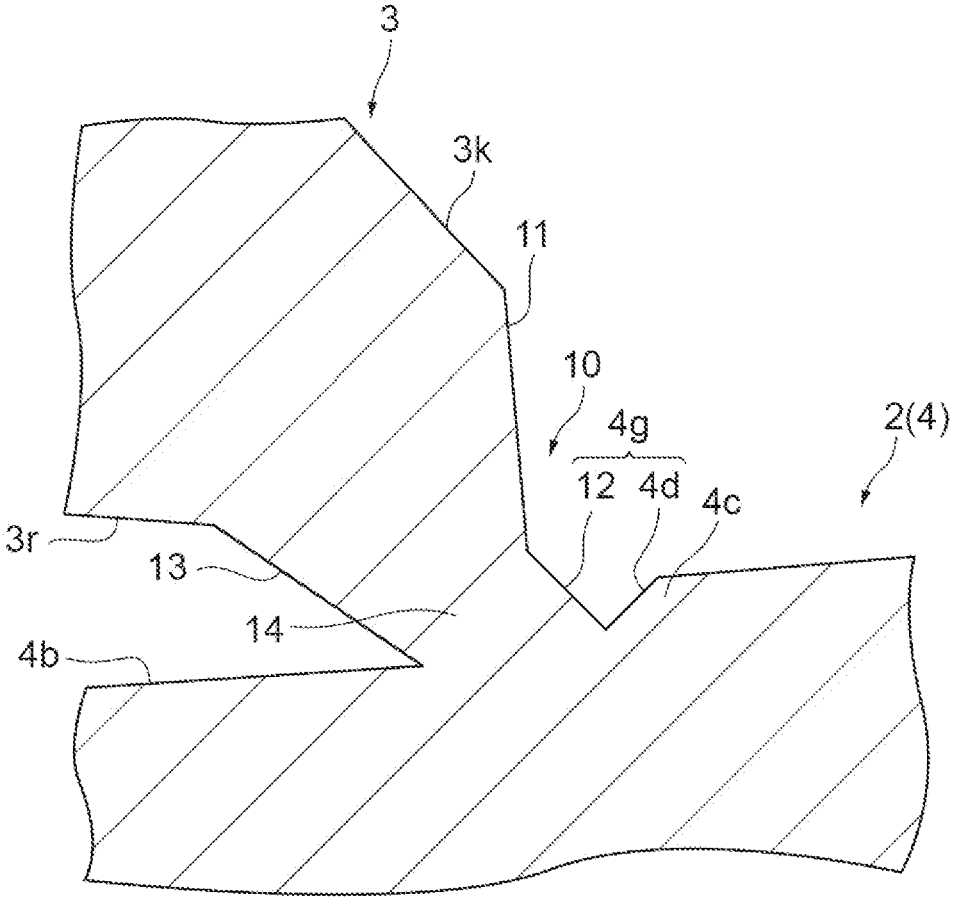
FIG. 10 is an enlarged cross-sectional view of the cutting portion illustrated in FIG. 8.

FIG. 10 is a more enlarged view of the cutting portion 10 illustrated in FIG. 8. With reference to FIGS. 8 to 10, a step 4c that is greater in diameter at a position that is offset from the opening 2b in the axial direction D1 is formed in the outer peripheral surface 4b of the main body 2 (tubular tip portion 4). The cutting portion 10 is formed in a recess 4g located between the opening 2b and the step 4c. An inclined surface 4d extends radially inwardly from the step 4c to be recessed toward the cutting portion 10.

The cutting portion 10 is formed by, for example, a first outer surface 11 extending radially inwardly from the inclined surface 3k of the cap 3, a second outer surface 12 extending from a radially inward end of the first outer surface 11 to the inclined surface 4d, and an inner surface 13 extending obliquely from the inner surface 3r of the cap 3 to outer peripheral surface 4b of the main body 2. The cutting portion 10 includes a thin portion 14 extending between the second outer surface 12 and the inner surface 13.

The recess 4g includes, for example, the second outer surface 12 and the inclined surface 4d, and is a V-shaped groove extending in the rotation direction (or circumferential direction) D2. When the cap 3 is rotated with respect to the main body 2 in the rotation direction D2, the thin portion 14 located between the opening 2b and the recess 4g is stretched until the thin portion 14 is broken (or split), so as to separate the cap 3 from the main body 2.

Figure 11:
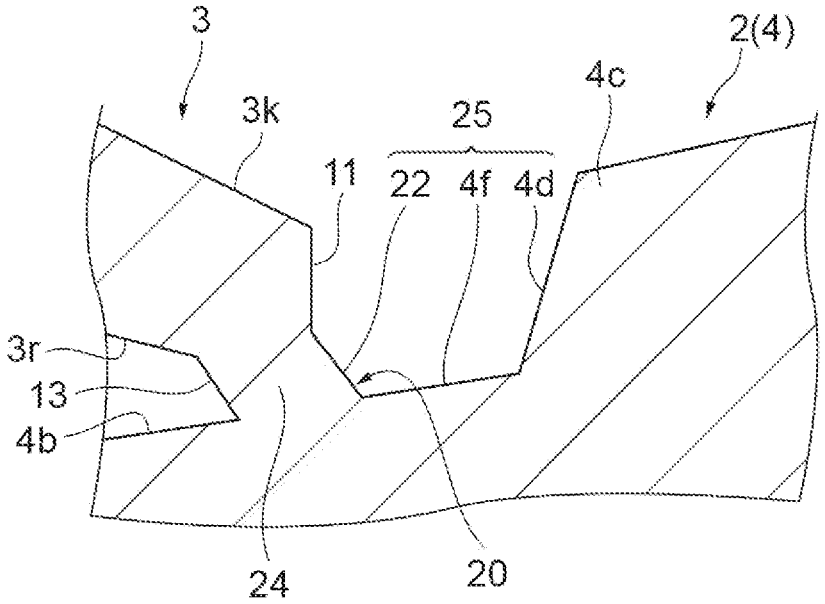
FIG. 11 is a cross-sectional view illustrating a cutting portion in an application container according to a modification example.

An example of the shape of the cutting portion 10 has been described above. However, the shape of the cutting portion is not limited to the above-described example. For example, in a cutting portion 20 illustrated in FIG. 11, the step 4*c* may include an inclined surface 4*d* and a bottom surface 4*f* located at a lower end (e.g., a radially inward end) of the inclined surface 4*d*. The cutting portion 20 may include a second outer surface 22 extending from the radially inward end of a first outer surface 11 to the bottom surface 4*f*, instead of the second outer surface 12 illustrated in FIG. 10.

The cutting portion 20 forms a thin portion 24 extending between the second outer surface 22 and the inner surface 13, and a groove 25 that is a recess having a trapezoidal cross-sectional shape extending in the rotation direction D2. Additionally, in an application container 1 including the cutting portion 20, similarly to the cutting portion 10, when the cap 3 is rotated with respect to the main body 2, the thin portion 24 located between the opening 2*b* and the groove 25 is stretched until the thin portion 24 is broken, so that the cap 3 is separated from the main body 2.

Figure 12:
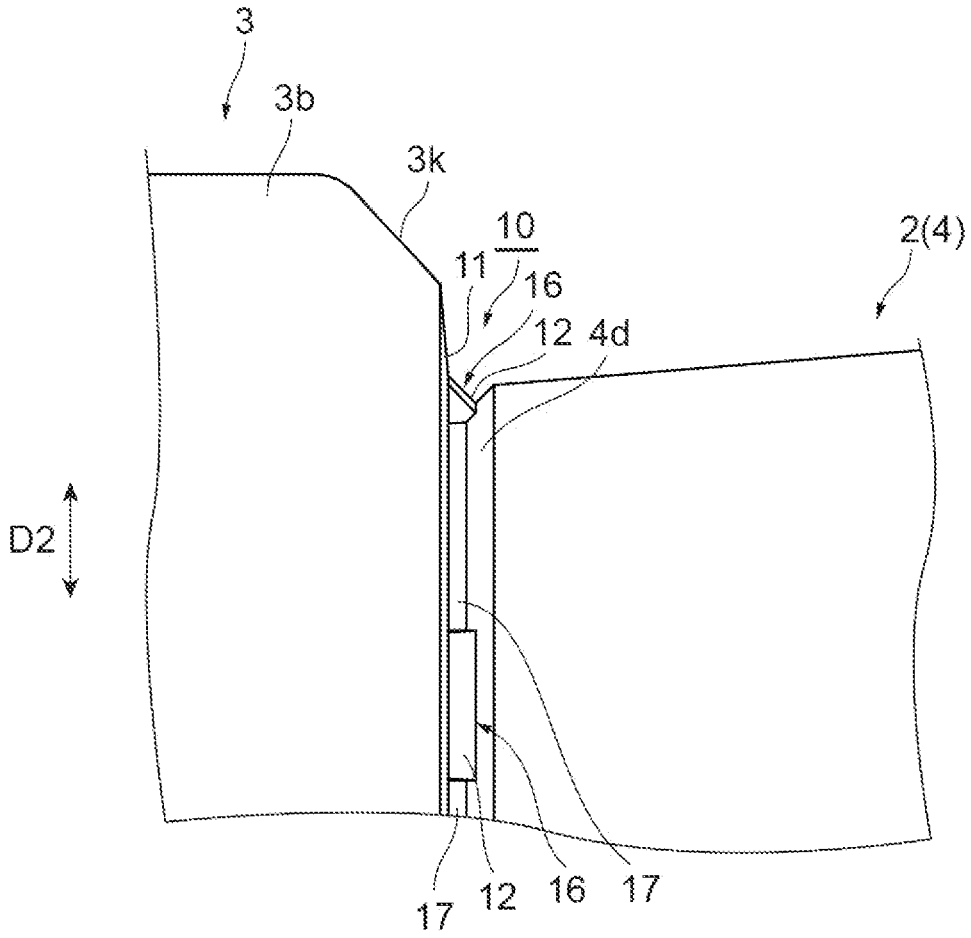
FIG. 12 is an enlarged partial side view illustrating the cutting portion of the application container of FIG. 1.

FIG. 12 is a view illustrating the cutting portion 10 when viewed from the outside of the main body 2 and the cap 3. As illustrated in FIG. 12, for example, the cutting portion 10 includes a plurality of connection portions 16 that are arranged along the rotation direction D2 and connect the cap 3 to the main body 2, and a plurality of gaps (or space portions) 17 arranged along the rotation direction D2 between adjacent pairs of connection portions 16. Accordingly, the cutting portion 10 forms a line of weakness in the rotation direction D2 that may be split or broken when the cap 3 is rotated relative to the main body 2.

The connection portion 16 includes, for example, the first outer surface 11, the second outer surface 12, and the inner surface 13 described above. The gap (or space portion) 17 forms a space between the first outer surface 11 and the inclined wall 4*d*, such that the second outer surface 12 is discontinued at the gap 17. Namely, the gap 17 forms an opening in a portion corresponding to (e.g., aligned with) the second outer surface 12, such that the main body 2 and the cap 3 are separated from each other in the gap 17. In the cutting portion 10, for example, the connection portions 16 and the gap 17 are alternately arranged along the rotation direction D2, and the connection portions 16 are intermittently formed along the rotation direction D2. In some examples, the cutting portion 10 may include four connection portions 16 and four gaps 17. The number of the connection portions 16 and of the gaps 17 may be varied depending on examples.

Figure 13:
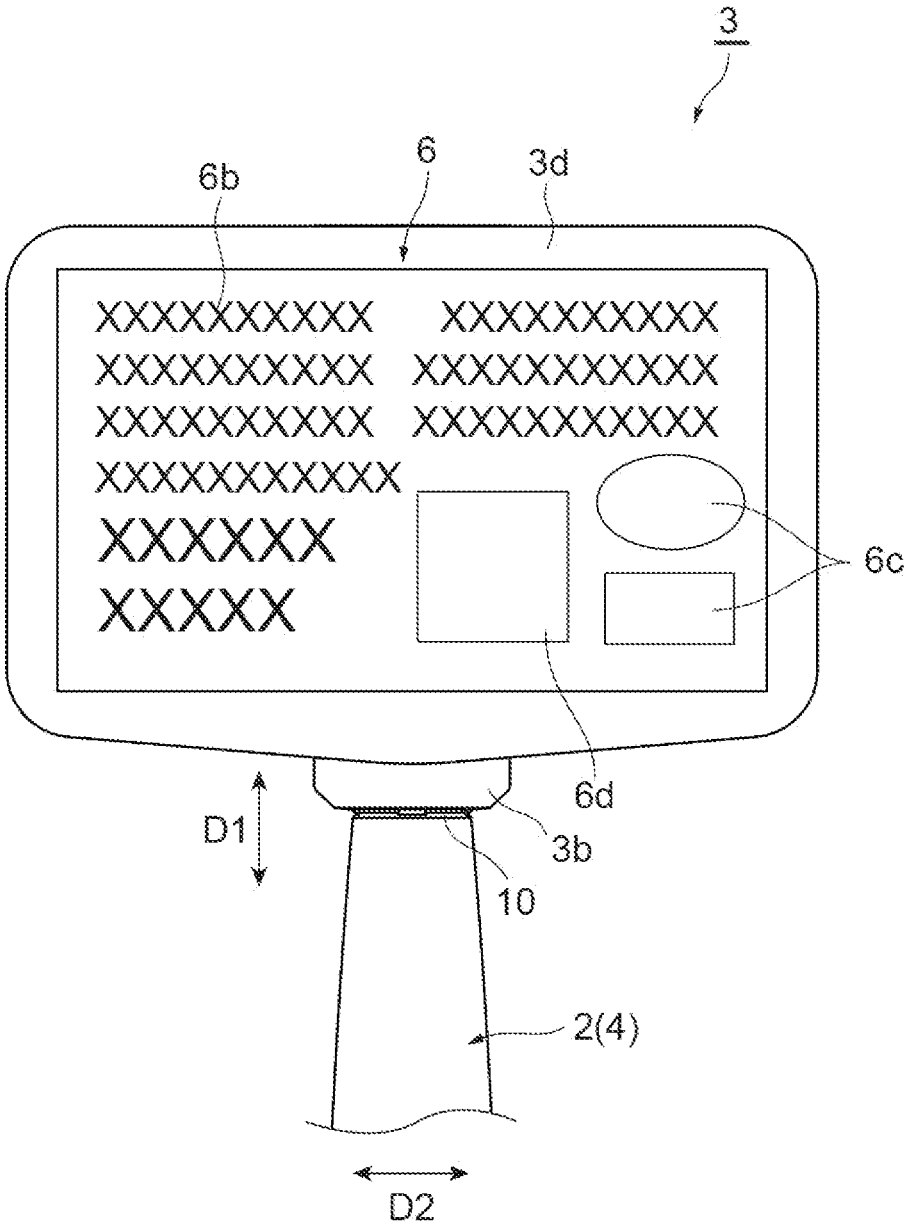
FIG. 13 is an enlarged view illustrating a wing portion of the cap of the application container of FIG. 1.

As described above, the cap 3 includes the wing portion 3*c*, and the information display portion 6 is provided on the main surface 3*d* of the wing portion 3*c*. FIG. 13 is a top view illustrating the information display portion 6. The information display portion 6 may be provided substantially on the entire surface of the main surface 3*d*, with reference to FIG. 13, or may be provided on a part of the main surface 3*d* according to other examples.

The information display portion 6 includes, for example, a flat surface. The information display portion 6 may include, for example, at least one of the product name of the application container 1, the type of the application container 1, the type of the cosmetic M (as one example, an eyebrow cosmetic, a concealer, or the like), company name, department name, country of production, address of place of production, the volume of the cosmetic M, the weight of the cosmetic M, and the color of the cosmetic M.

The information display portion 6 may include, for example, character information 6*b* and a mark 6*c*. The character information 6*b* refers to character information such as the product name of the application container 1 and the like described above. The mark 6*c* is, for example, a stamp indicating the type of the cosmetic M. The information display portion 6 may include a description or mark (for example, an arrow extending in the rotation direction D2) indicating a method for separating the cap 3 from the main body 2 by rotating the cap 3 with respect to the main body 2. This description or mark may be displayed on the tubular portion 3*b*. In this case, a user of the application container 1 is instructed to separate the cap 3 from the main body 2 via a rotation of the cap, so as to suppress the removal of the cap 3 in other ways that may be unsuitable.

The information display portion 6 may further include an identification code 6*d* that can be recognized by an information terminal. The information terminal may include, for example, a mobile terminal, and the mobile terminal includes terminals such as a mobile phone and a tablet which are portable. The identification code 6*d* is, for example, a QR Code (registered trademark) that allows for access to an internet site associated with the application container 1.

As described above, when the information display portion 6 includes a flat surface and the identification code 6*d* is displayed on the flat surface, the identification code 6*d* can be easily recognized by an information terminal. In the case where the information display portion 6 includes the identification code 6*d*, when a user who obtains the application container 1 as a free sample, for example, accesses the internet site associated with the application container 1 from the identification code 6*d*, the user can be provided with detailed information regarding the application container 1. Incidentally, the identification code 6*d* may be, for example, a barcode, and is not limited to a QR Code (registered trademark).

Effects obtained from the application container 1 according to examples will be described. As illustrated in FIG. 8, the application container 1 includes the main body 2 having a tubular shape and holding the cosmetic M, and the cap 3 having a tubular shape. The main body 2 includes the opening 2*b* that exposes the cosmetic M, and the cap 3 covers the cosmetic M exposed from the opening 2*b*. The cutting portion (or weakened portion) 10 that connects the main body 2 to the cap 3 is provided between the main body 2 and the cap 3, and when cutting is performed at the cutting portion 10, the cap 3 is separable from the main body 2.

The cutting portion 10 is provided at the position located away from the opening 2*b* in the axial direction D1 of the main body 2, with the cosmetic M being exposed from the opening 2*b*, and connects the outer peripheral surface 4*b* of the main body 2 to the cap 3 at the position located away from the opening 2*b*. Accordingly, since the cutting portion 10 is provided at the position separated from the opening 2*b* in the axial direction D1, the cap 3 or the like can be prevented from coming into contact with the cosmetic M when cutting is performed at the cutting portion 10.

Therefore, the cosmetic M can be protected by preventing the cosmetic M from being damaged when cutting is performed. In the example illustrated in FIG. 9, since the outer peripheral surface 4*b* of the tubular tip portion 4 comes into contact with the inner surface 3*r* of the cap 3, the cap 3 can be prevented from coming into contact with the cosmetic M. In addition, even when a surface where cutting is performed is rough, since the cutting portion 10 is provided at the position located away from the opening 2*b* in the axial direction D1, a rough portion can be prevented from coming into contact with the target portion (or target surface) such as the skin of a person, when the cosmetic M is abutted against and applied to the target portion. Therefore, the rough portion can be prevented from coming into contact with the target portion, so as to improve the ease of use of the cosmetic M. Further, safety to the user is improved by suppressing the rough portion from abutting against the skin.

In some examples, the cap 3 includes the tubular portion 3*b* covering the cosmetic M, and the wing portion 3*c* protruding from the tubular portion 3*b* in the direction intersecting the axial direction D1. Accordingly, when the cap 3 is rotated by hand with respect to the main body 2 for separating the cap 3 from the main body 2, the wing portion 3*c* protruding from the tubular portion 3*b* can be gripped by the user's hand, so as to more easily carry out the rotation. Namely, since the wing portion 3*c* extends radially outwardly from the tubular portion 3*b*, the wing portion 3*c* forms a lever that can be rotated by the hand, so that the cap 3 can be more easily rotated.

In some examples, the wing portion 3*c* includes the information display portion 6 that displays information regarding the cosmetic M. Accordingly, the wing portion 3*c* protruding from the tubular portion 3*b* of the cap 3 can be effectively used as the information display portion 6 that displays the information. Namely, since the wing portion 3*c* protrudes in a wing shape from the tubular portion 3*b*, the main surface 3*d* on an outer side of the wing portion 3*c* can be effectively used as the information display portion 6.

In the example illustrated in FIG. 12, the cap 3 is separable from the main body 2 through the cutting portion 10 by rotating the cap 3 with respect to the main body 2. The cutting portion 10 includes the plurality of connection portions 16 that are arranged along the rotation direction D2 which is a direction in which the rotation is performed, and that connect the cap 3 to the main body 2, and the plurality of gaps (or space portions) 17 located between adjacent pairs of the connection portions 16 and arranged along the rotation direction D2. Accordingly, since the plurality of connection portions 16 are intermittently provided in the cutting portion 10 along the rotation direction D2, the cap 3 can be more easily cut from the main body 2 when the cap 3 is rotated relative to the main body 2.

In the example illustrated in FIG. 10, the step 4*c* that increases in diameter rearwardly, away from the opening 2*b* in the axial direction D1, is formed in the outer peripheral surface 4*b* of the main body 2, and the cutting portion 10 is formed in the recess 4*g* located between the opening 2*b* and the step 4*c*. Accordingly, since the cutting portion 10 is formed in the recess 4*g* between the opening 2*b* and the step 4*c*, even when the cut surface is rough after cutting, such a rough surface can be prevented from protruding relative to the outer peripheral surface 4*b* of the main body 2.

Namely, even when a rough surface results from the cutting, the rough surface is formed in the recess 4*g*, so that the rough surface can be prevented from protruding relative to the outer peripheral surface 4*b* of the main body 2. Accordingly, a likelihood that the rough surface formed by cutting contacts the target portion (or target surface) can be further reduced, so as to improve ease of use of the cosmetic M by a user.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, the shapes, sizes, number, materials, and disposition mode of the portions of the application container are not limited to the above-described examples, and can be appropriately changed.

For example, although the example cutting portion 10 described includes the connection portions 16 intermittently formed along the rotation direction D2, the configuration of the cutting portion is not limited to the example cutting portion 10. For example, the cutting portion may include one or more thin connecting portions between the connecting portions 16, instead of the gaps 17, such that the thin connecting portions are thinner than the connecting portion 16.

Additionally, although the example cap 3 described includes the information display portion 6 provided on the main surface 3*d* of the wing portion 3*c*, the information displayed on the information display portion 6 is not particularly limited. In addition, the information display portion may be provided at a location other than the main surface 3*d* of the wing portion 3*c* in some examples, and the information display portion may be omitted from the wing portion in some examples.

Additionally, although an example has been described in which the tubular portion 3*b* and the wing portion 3*c* are provided and the wing portion 3*c* is fixed to the plurality of fixing portions 3*p* arranged along the axial direction D1 in some examples, the wing portion may not be fixed via the fixing portions 3*p*, and may be, for example, a plate portion extending from the surface of the tubular portion 3*b*. In addition, although the example cap 3 described includes the wing portion 3*c* that extends to both sides of the tubular portion 3*b* in the lateral direction D3 in some examples, the wing portion of the cap may extend from the tubular portion 3*b* to one side of the tubular portion 3*b* in the lateral direction D3, and is therefore not limited to the shape extending laterally from the tubular portion 3*b* to both sides. In yet other examples, a cap omitting the wing portion may be provided.

Additionally, although an example has been described in which the cutting portion 10 is formed between the opening 2*b* and the step 4*c* in the tubular tip portion 4 of the main body 2, the location of the cutting portion may be formed may be located further away from the opening from which the cosmetic M is exposed, and can be suitably changed. Further, although an example has been described in which the cosmetic M is an eyebrow cosmetic and the application container 1 is an eyebrow cosmetic holding container, the application container according to other examples can be applied to a variety of stick-shaped cosmetics such as an eyeliner, a concealer, and a lip liner.

Additionally, although an example has been described in which the application material is the cosmetic M, the application material may be a material other than the cosmetic M, and may be, for example, a brush, a pencil, a sponge, or the like impregnated with a liquid such as a liquid cosmetic. Further, the application container may be a container other than a cosmetic container, and may be a writing tool, a design pencil, stationery, or the like including a drawing material as the application material. Accordingly, the application container can be applied to a variety of containers.

The invention claimed is:

1. An application container comprising:

a main body that holds an application material, wherein the main body has a tubular shape extending in an axial direction and forming an opening to expose the application material, wherein an outer peripheral surface of the main body includes a recess that extends in a circumferential direction of the main body, and a step portion located adjacent the recess, wherein the outer peripheral surface has a greater diameter at the step portion than at the recess, and wherein the recess is offset from the opening in the axial direction and located between the opening and the step portion;

a cap having a tubular portion that overlaps the opening of the main body in the axial direction; and a weakened portion that is formed between the tubular portion of the cap and the outer peripheral surface of the main body so that the weakened portion is arranged substantially in the circumferential direction of the main body, wherein the weakened portion is formed in the recess of the main body so that the weakened portion is located away from the opening in the axial direction of the main body, and wherein the weakened portion is configured to be split in response to an external force, so as to separate the cap including the tubular portion, from the main body including the opening that exposes the application material with the cap removed.

2. The application container according to claim 1, wherein the cap includes a wing portion protruding from the tubular portion in a direction intersecting an axial direction of the tubular portion.

3. The application container according to claim 2, wherein the wing portion includes an information display portion displaying information regarding the application material.

4. The application container according to claim 1, wherein the weakened portion includes a plurality of connection portions arranged in the circumferential direction, that connect the tubular portion of the cap with the main body, and a plurality of gaps arranged in the circumferential direction between adjacent pairs of the connection portions so as to separate the cap from the main body in response to a rotation of the cap relative to the main body.

* * * * *